United States Patent [19]

Cobb

[11] 4,043,389

[45] Aug. 23, 1977

[54] RAM-SHEAR AND SLIP DEVICE FOR WELL PIPE

[75] Inventor: A. Tom Cobb, Seabrook, Tex.

[73] Assignee: Continental Oil Company, Ponca City, Okla.

[21] Appl. No.: 671,464

[22] Filed: Mar. 29, 1976

[51] Int. Cl.[2] ..... E21B 29/00

[52] U.S. Cl. ..... 166/55; 285/145

[58] Field of Search ..... 166/.5, .6, 55, 55.2, 166/55.6; 24/263 D, 263 DB, 263 DA, 263 KC, 263 DL, 263 DC, 263 DD, 263 DS, 263 DH; 285/141, 145, 144

[56] References Cited

U.S. PATENT DOCUMENTS

| | | | |
|---|---|---|---|
| 1,802,564 | 4/1931 | Lacey | 166/55 X |
| 1,802,565 | 4/1931 | Lacey | 166/55 X |
| 3,454,289 | 7/1969 | Fowler | 24/263 DH X |
| 3,561,526 | 2/1971 | Williams, Jr. et al. | 166/55 |
| 3,692,107 | 9/1972 | Slator et al. | 166/55 |
| 3,736,982 | 6/1973 | Vujasinovic | 166/55 |

*Primary Examiner*—Ernest R. Purser
*Assistant Examiner*—Richard E. Favreau
*Attorney, Agent, or Firm*—Richard W. Collins

[57] ABSTRACT

Blowout prevention equipment for use in a well operation is described. The equipment includes a combination of a ram-shear designed to sever a pipe string extending through the blowout prevention equipment down into a wellbore and a slip device positioned below the ram-shear to hold the severed lower portion of the pipe string and to prevent it from falling down into the wellbore. The slip device and the ram-shear may be operated simultaneously by a hydraulic control system so that the slip device is in position to hold the severed pipe string as the pipe string is sheared. The slip device includes a split slip bowl movable into proximity of the pipe string and plurality of gripping segments carried by each section of the slip bowl.

1 Claim, 5 Drawing Figures

RAM-SHEAR AND SLIP DEVICE FOR WELL PIPE

BACKGROUND OF THE INVENTION

1. Field of the Invention

This invention relates generally to blowout prevention equipment as used, for example, in the drilling of oil and gas wells. More particularly, this invention relates to blowout prevention equipment of the type including a ram assembly that will shear a pipe string extending through the blowout preventer when the rams of the assembly are forced together. Such ram-shears are desirable in blowout prevention equipment used in a well operation where there is the possibility of a situation arising such that it would be desirable to sever the drill pipe or tubing. This situation might arise, for example, during a drilling operation conducted from a floating vessel if the anchor system should fail or for some other reason the vessel could not be safely retained over the well site. In such situations, it is sometimes necessary to shear the pipe string at the wellhead to avoid severe damage to the wellhead or the floating vessel. In some instances, such as when the pipe string is being removed from the well to change drilling bits, and an emergency arises before the pipe string is completely removed from the well, the sheared pipe string may fall back into the well causing a delay in operations while the severed pipe string is recovered, and in some cases the well is irretrievably damaged such that it is a total loss. Thus, there has been a need for a blowout preventer which enables an operator to sever a pipe string and at the same time prevent the severed pipe from falling down into the well.

2. Description of the Prior Art

Ram-shear assemblies for blowout preventers are now routinely available. Conventional devices for shearing a pipe string and shutting off a well are effective, but prior to this invention ram-shear assemblies have had no provision for retaining the severed pipe string and preventing it from falling down into the well. A ram-shear assembly of the type presently used commercially is described in U.S. Pat. No. 3,561,526, wherein the shearing assembly also provides a seal after the pipe has been severed. Blowout prevention equipment including a ram-shear assembly and a shutoff ram assembly below the shearing assembly is described in U.S. Pat. No. 3,736,982. The lower assembly in the apparatus described in that patent provides a pressure seal about the severed lower portion of the pipe string, but it has no provision for preventing the severed portion of the pipe string from falling down into the well, such that it is primarily useful in the situation where the drill bit is resting on the bottom of the hole.

A device for cutting a tubing string extending into a well and clamping means for retaining the severed pipe is described in U.S. Pat. No. 3,692,107. This device is, however, not suitable for blowout prevention utilization, and is not so intended.

Thus, prior to this invention there has been no suitable equipment available to prevent a sheared pipe string which is suspended from drilling or servicing equipment from droping into the well when ram-shear blowout prevention devices are actuated in a threatened or actual blowout crisis. Without means for suspending the severed pipe string, the pipe string will drop to the bottom of the well, causing delay, expense and possible loss of the well.

SUMMARY OF THE INVENTION

According to the present invention, a slip device is provided in combination with a ram-shear in the blowout prevention stack of a well. The slip device is positioned below the ram-shear and preferably actuated simultaneously with the ram-shear by a hydraulic or other type of control system to retain the severed pipe and prevent it from dropping into the well. The ram-shear portion of the equipment may be of conventional design, and the slip device of the invention may be operated in the same manner as a conventional ram seal of the type sometimes included in a blowout prevention stack below a ram-shear.

The basic benefit provided by the present invention is the ability to retain the severed portion of a pipe string in a position where it is accessible at such time as the drilling or other well operation is to be resumed.

It is, therefore, an object of the present invention to provide an improved blowout prevention assembly including a ram-shear and a slip device below the ram-shear for retaining the severed portion of a pipe string.

It is a further object to provide such an assembly in which the ram-shear and the slip device are actuated by a common control system.

The foregoing as well as additional objects and advantages are provided by this invention as will be apparent from consideration of the following detailed description of a preferred embodiment of the invention.

DESCRIPTION OF THE PREFERRED EMBODIMENT

The following detailed description of the preferred embodiment of the invention, as illustrated in the accompanying drawings, is for purposes of illustrating the invention, and it will be appreciated that various modifications and variations or substitutions could be made without departing from the broader aspects of the invention.

Figure 1:
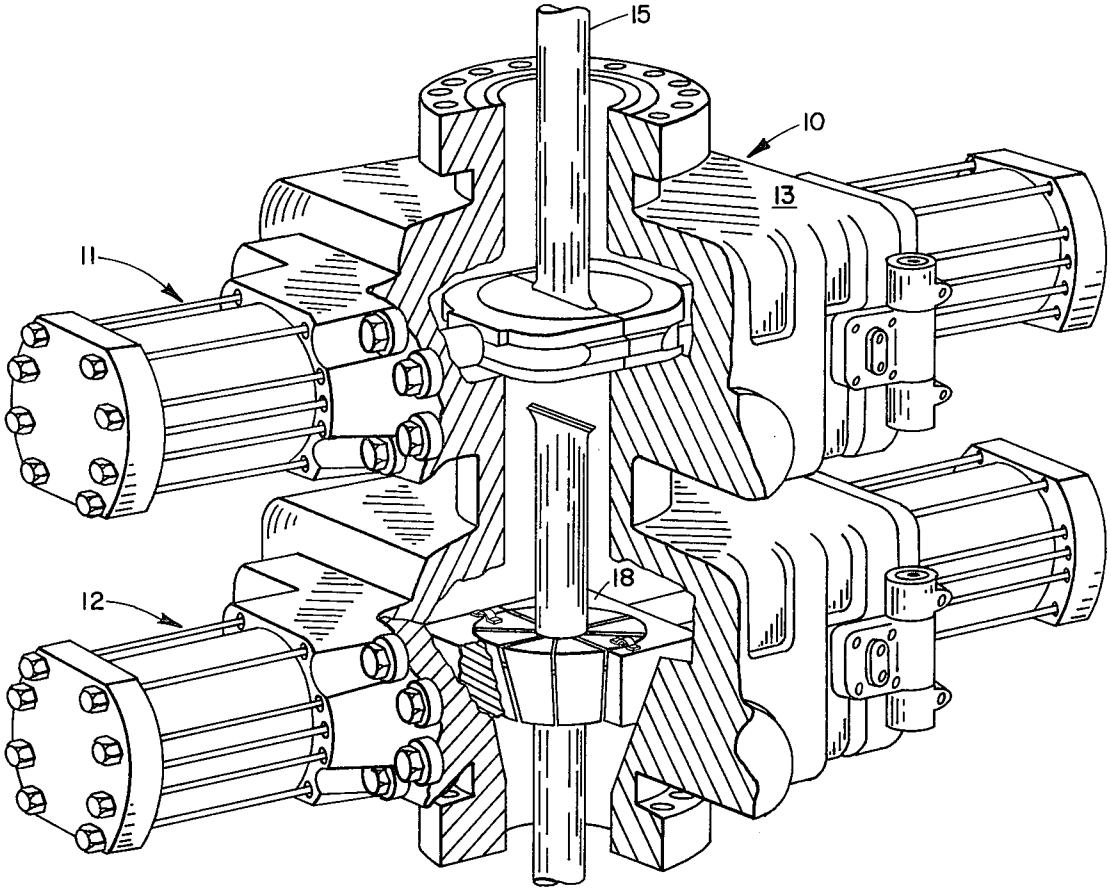
FIG. 1 is a perspective view, partially cut away, showing a combination ram-shear and slip device in accordance with the invention.

Referring to FIG. 1, a blowout prevention stack as indicated generally at 10 is illustrated having an upper ram-shear assembly 11 and a lower slip device 12. The blowout prevention stack 10 as depicted in FIG. 1 is a conventional design well known to those skilled in the art insofar as the case 13 and the ram pistons contained therein are concerned. As this portion of the apparatus, including the upper ram-shear mechanism, is basically conventional, the following description deals primarily with the slip device 12. Most blowout prevention stacks presently in use utilize hydraulic pressure to actuate the rams associated therewith, although other types of actuation are in use and may be utilized in place of hydraulic means if desired. In some cases, to assure that a ram-shear assembly contacts a portion of a pipestring other than a tool joint, which generally can not be severed by the shear, two ram-shear assemblies may be provided and spaced apart a distance to assure that at least one of the ram-shear assemblies does not make contact with a tool joint upon operation of the apparatus. Similarly, it may be desirable to include a ram-seal assembly below the slip device to isolate the well pressure from the portion of the assembly above the ram-seal.

Figure 2:
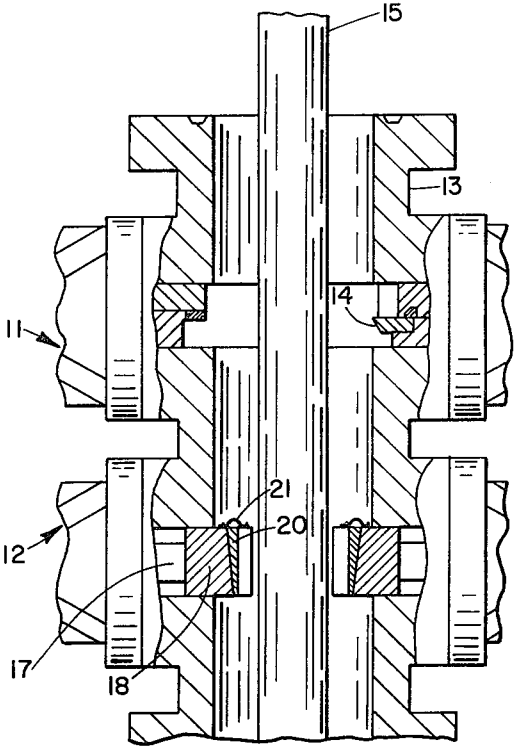
FIG. 2 is a partial sectional view of a combination ram-shear and slip device showing both the shear and the slip device in an open position.
Figure 3:
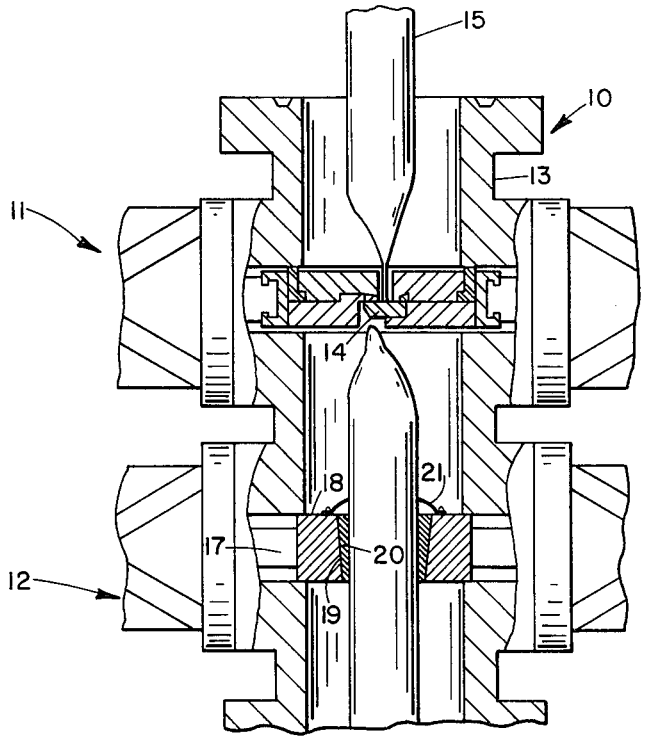
FIG. 3 is a partial sectional view similar to FIG. 2 and showing the shear device in the cutting position and the slip device in the pipe retaining position.

Referring now to FIGS. 1, 2 and 3, the blowout prevention stack 10 is provided with an upper ram-shear assembly 11, shown in the closed position and FIGS. 1 and 3 and in the open position in FIG. 2. The ram-shear assembly 11 includes a cutting element 14 (FIG. 2) which upon actuation of the ram-shear assembly 11 contacts and severs pipe string 15 extending through the blowout prevention stack 10. FIGS. 2 and 3 respectively show the ram-shear assembly in the open and closed position.

The slip device of this invention is in some respects similar to pipe-retaining slip devices of the type commonly used in many well operations. Such slip devices generally include a slip bowl with a central opening through which a pipe string extends. The opening is usually tapered from a first lower diameter to a larger upper diameter, and a plurality of joined together gripping segments having rear surfaces shaped to conform to the surface of the opening in the slip bowl are provided. These gripping segments have inner serrated or toothed inner surfaces adapted to engage the wall of a pipe extending therethrough.

The slip device 12 of this invention is depicted in FIGS. 1, 2 and 3, with FIG. 2 showing the slip device in an open position and FIG. 3 showing the slip device in the closed or pipe-retaining position. Preferably, slip device 12 and ram-shear assembly 11 are simultaneously actuated by a common control system such that the slip device 12 is in a pipe-retaining position at the time that the pipe string 15 is severed.

Figure 4:
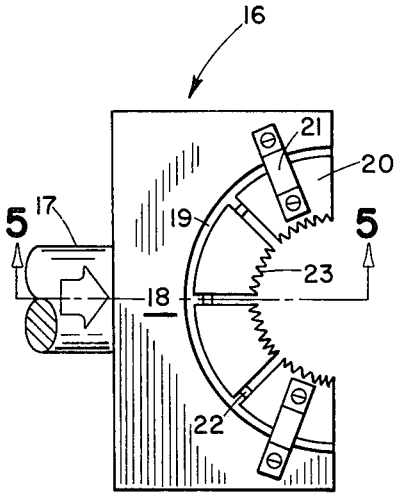
FIG. 4 is a top plan view of one section of a preferred version of the slip device.
Figure 5:
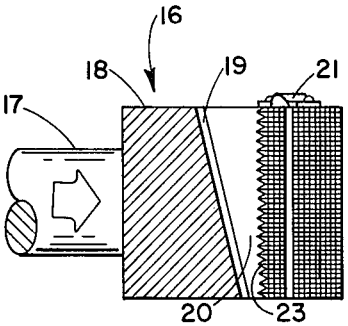
FIG. 5 is a cross-section taken through line 5—5 of FIG. 4.

Referring now to FIGS. 4 and 5, a preferred form of slip device includes a pair of opposed half sections 16. FIG. 4 shows a top plan view of one such half section 16, and includes a ram arm 17 which is actuated by the hydraulic control system of the blowout prevention stack in a known manner. Ram 17 is affixed to bowl member 18 which has a portion thereof cut away to provide a surface of semi-circular cross section and having a first lower diameter and a larger upper diameter thereby providing a sloping shoulder surface 19 as best seen in FIG. 5. Slip device 12 is comprised of two mirror image half sections 16 attached to opposing rams 17 as shown in FIGS. 1, 2 and 3.

A plurality of gripping segments 20 are attached to slip bowl section 18 by resilient straps 21, and each of the gripping segments 20 is loosely connected to an adjoining gripping segment by a connecting member 22. The combination of slip bowl 18, straps 21 and gripping segments 20 thus comprise a unitary structure movable with ram 17 from the open position of FIG. 2 to the closed position of FIG. 3. The connecting members 22 joining the gripping segments 20 allow for limited movement of the gripping segments relative to one another as is conventional for slip devices of this type. Gripping segments 20 each include on the inner surface thereof a plurality of teeth or projections 23 for contact with the outer surface of pipe string 15 when in the closed position shown in FIG. 3.

It will be appreciated that numerous variations and modifications could be made to the equipment as described above. For example, a stationary slip bowl could be provided, and the movable rams of the slip device could be connected by suitable linkage to the gripping segments 20 to place them into the retaining position. Further, the rams actuating the shear and the slip could be powered by other than hydraulic means, although hydraulic power is generally preferred.

Operation

The operation of the blowout prevention stack as described above will be readily apparent to those skilled in the art, but will be briefly described below.

During a well drilling operation, the blowout prevention stack of this invention is maintained in the configuration shown in FIG. 2 where the ram-shear assembly is out of contact with the pipe string 15 and the slip device 12 is likewise in a retracted or open position such that pipe string 15 and associated tool joints (not shown) may freely move longitudinally of the blowout prevention stack. Upon the occurrence of a threatened or actual blowout crisis, or upon occurrence, for example, of a storm which threatens to force a floating offshore drilling rig away from the well location, such that a decision is made to sever pipe string 15 in order to "get loose from" the well, the control system of blowout prevention stack 10 is actuated to simultaneously cause ram-shear assembly 11 to move to the position shown in FIG. 3, severing pipe string 15, and to cause slip device 12 to move to the position shown in FIG. 3, whereby the slip device 12 contacts and retains the lower severed portion of pipe string 15, preventing the severed portion from falling down into the well. Without the inclusion of slip device 12 in the blowout prevention assembly, the severed portion of pipe string 15 would fall back into the well if the bit or other tool at the end of the pipe string were not in contact with the bottom of the hole at the time the pipe string is severed.

As will be appreciated by those familiar with the operation of slip devices, the sloping shoulder surface 19 in combination with lateral pressure of gripping segments 20 and their associated teeth 23 against the outer wall of the pipe string provides a positive gripping action whereby the severed section of pipe is prevented from downward movement so long as the slip bowl sections 18 are maintained in the inner position shown in FIG. 3.

As a result of the operation of the blowout prevention equipment described above, a floating drilling rig is enabled to get loose from a well in a crisis condition, and upon return to normal conditions the floating drilling rig can be re-positioned over the well, the severed pipe string can be connected to suitable means for pulling it up out of the blowout preventer, and normal well operations may be resumed without the necessity of retrieving a dropped section of drill string.

What is claimed is:

1. Blowout prevention apparatus comprising:

a ram-shear forming a part of said apparatus and adapted to sever a pipe string extending therethrough into a wellbore; and a slip device forming a part of said apparatus, said slip device being positioned below said ram-shear and being movable from a first position in which said pipe string is freely movable therethrough to a second position in which said pipe string is gripped and retained, said slip device comprising a pair of half-sections each movable toward and away from a pipe string extending therethrough and each of said half-sections comprising a bowl member and a plurality of gripping segments attached to said bowl member whereby upon movement of said half-sections toward a pipe string extending therethrough said gripping segments contact said pipe string and prevent downward travel thereof, said gripping segments being attached by strap connectors extending from the top of said bowl member to the top of a gripping segment.

* * * * *